US005333595A

United States Patent [19]

Heffron

[11] Patent Number: 5,333,595

[45] Date of Patent: Aug. 2, 1994

[54] ARCHERY BOW ASSEMBLY

[76] Inventor: Duane Heffron, 6655 N. Lucas, Manton, Mich. 49663

[21] Appl. No.: 869,146

[22] Filed: Apr. 14, 1992

[51] Int. Cl.[5] ..... F41B 5/00

[52] U.S. Cl. ..... 124/88; 124/23.1; 124/24.1

[58] Field of Search ..... 124/23.1, 24.1, 256, 124/86, 88, 89

[56] References Cited

U.S. PATENT DOCUMENTS

| | | | |
|---|---|---|---|
| 3,129,525 | 4/1964 | Lewis | 124/24.1 X |
| 3,171,397 | 3/1965 | Daly | 124/23.1 |
| 3,176,674 | 4/1965 | Smith | 124/23.1 |
| 4,787,361 | 11/1988 | Vyprachticky | 124/88 |
| 4,957,093 | 9/1990 | Hamlett | 124/88 |
| 5,113,841 | 5/1992 | Bratcher | 124/23.1 |
| 5,119,796 | 6/1992 | Dehlbom | 124/23.1 |

*Primary Examiner*—Randolph A. Reese
*Assistant Examiner*—John Ricci
*Attorney, Agent, or Firm*—Douglas S. Bishop

[57] ABSTRACT

An archery bow assembly including a central handle section that is positioned and configured to provide a natural position for the archer's hand and to minimize chafing of the bow string against the inner surface of the forearm of the archer upon release of the bow string. The handle section includes a generally planar main body portion connected at its upper end to the lower end of the upper limb section and connected at its lower end to the upper end to the lower end of the upper limb section and a handle portion formed integrally with the main body portion and laterally offset with respect to the main body portion and with respect to the central plane of the bow assembly. The handle portion defines an oblique grasping surface that extends downwardly away from the central plane and the grasping surface is sculptured to define individual concave surface areas for respective receipt of each finger of the archer's hand so that each successive finger, counting away from the thumb, is positioned successively further away from the central plane of the bow so as to rotate the forearm of the archer to a natural, comfortable position and a position in which the archer's forearm is essentially removed from the path of movement of the bow string.

7 Claims, 3 Drawing Sheets

18x
1
2
18r
3
4
18s
T
18e 20
14a
18q
18x
18j
18b
18k
18L
18m
18n
18a
18f
18g
18d
20

20
14
14a
18c
18x
18k
18L
18b
18m
18n
18p
18f
18a
18e
18d
16a
16a
16

ARCHERY BOW ASSEMBLY

BACKGROUND OF THE INVENTION

This invention relates to an archery bow assembly and more particularly to an archery bow assembly which is configured to minimize twisting of the bow at arrow release and to minimize strumming of the bow string against the forearm of the archer.

Archery bow assemblies have been in use for centuries for various purposes including hunting, target shooting, and the like. However, shooting the bow has always had the problem of the bow string striking and chafing the archer's forearm as the arrow is release. Forearm protectors of one type or another are therefore almost universally used, some independent of the bow and others comprising an integral accessory of the bow. Even with the forearm properly protected, problems remain. Specifically, if the bow string and the arrow nocked thereon are permitted to strike the archer's arm, the flight of the arrow is thrown to one side causing erratic flight and a loss of accuracy. A further loss in accuracy results from reflex movement of the archer's arm in response to the striking action of the bow string. Further, if the archer bends his arm in an attempt to remove his forearm from the path of the bow string, a side-wise movement is introduced that pushes the bow in a direction other than in parallel relation to the flight of the arrow toward its target, with consequent loss in accuracy.

SUMMARY OF THE INVENTION

This invention is directed to the provision of an archery bow assembly which is configured to minimize twisting of the bow at arrow release and minimize strumming of the bow string against the forearm of the archer.

The invention archery bow assembly includes a bow having upper and lower limb sections and a central section interconnecting the limb sections and a bow string extending between the free ends of the limb sections and lying in a common plane with the limb sections. According to the invention, the central section includes a handle portion that is laterally offset with respect to the common plane and extends at an angle to the plane. The offset aspect of the handle portion displaces the forearm of the archer away from the pat of the bow string and the angled aspect of the handle portion has the effect of rotating the forearm further away from the path of the bow string.

According to a further feature of the invention, the handle portion includes a grasping surface adapted to receive the four fingers of the archer's hand in side-by-side relation and disposed obliquely with respect to the plane of the limb sections and the bow string.

According to a further feature of the invention, the surface extends downwardly away from the plane so that the first finger is positioned in relative proximity to the plane and each successive finger is positioned further away from the plane. This arrangement has the effect of rotating the forearm of the archer away from the path of the bow string to preclude or minimize chafing or strumming of the bow string against the forearm and to allow the archer's hand to occupy a natural, relaxed disposition relative to the bow.

According to a further feature of the invention, the grasping surface is sculptured to define a individual concave surface areas for respective receipt of each finger. This arrangement facilitates the firm positive grasping of the handle by the archer and minimizes movement of the archer's hand relative to the handle during operation of the bow assembly.

According to a further feature of the invention, the uppermost position of the grasping surface, adapted to receive the first finger, is laterally offset from the adjacent side edge of the bow. This arrangement has the effect of laterally displacing the archer's forearm further away from the path of the bow string so as to further minimize or preclude chafing of the bow string against the archer's forearm.

According to a further feature of the invention, the central section further includes a main body portion integral with the handle portion and connected at its upper end to the lower end of the upper limb section and connected at its lower end to the upper end of the lower limb section, and the front edge of the handle portion extends forwardly beyond the front edge of the main body portion. This arrangement allows the archer's fingers to wrap around the front edge of the handle portion to further facilitate firm grasping of the handle by the archer.

DETAILED DESCRIPTION OF THE PREFERRED EMBODIMENT

Figure 3:
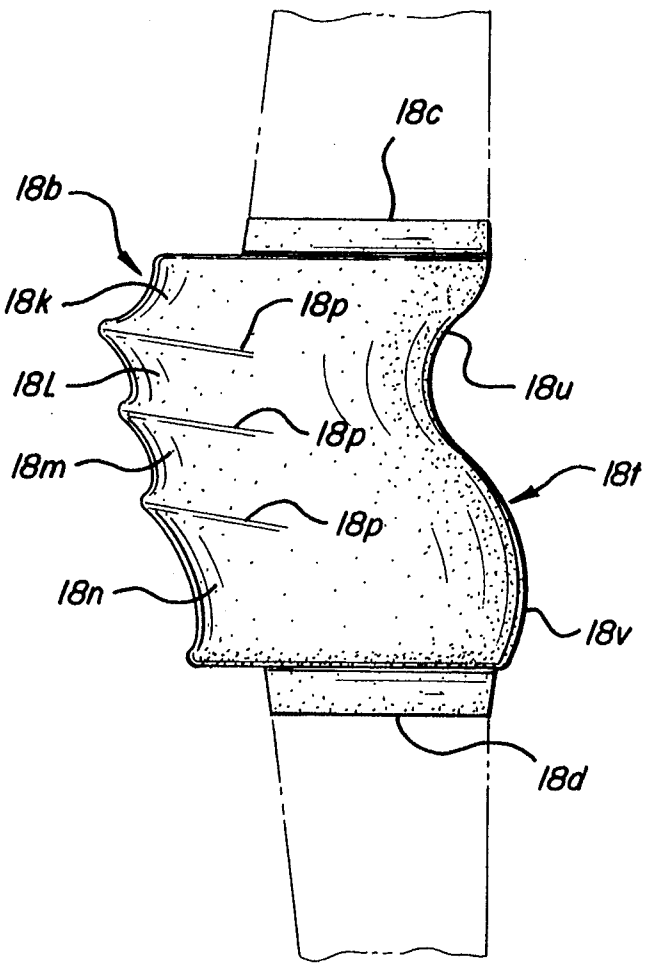
FIGS. 3, 4, 5 and 6 are left side, front, rear and right side views of a handle section employed in the invention archery bow assembly.
Figure 2:
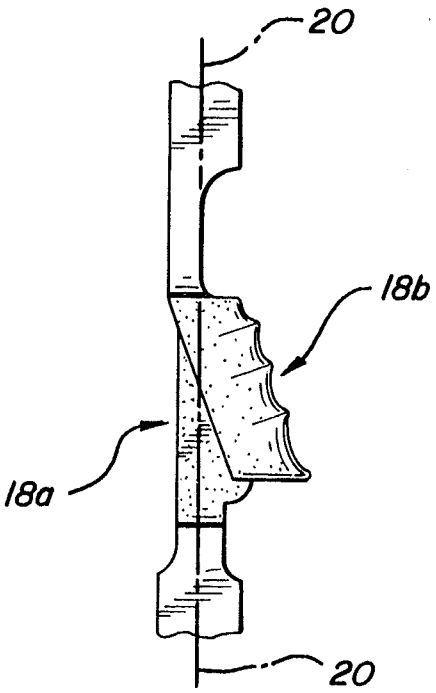
FIG. 2 is a fragmentary front view of the invention archery bow assembly.
Figure 1:
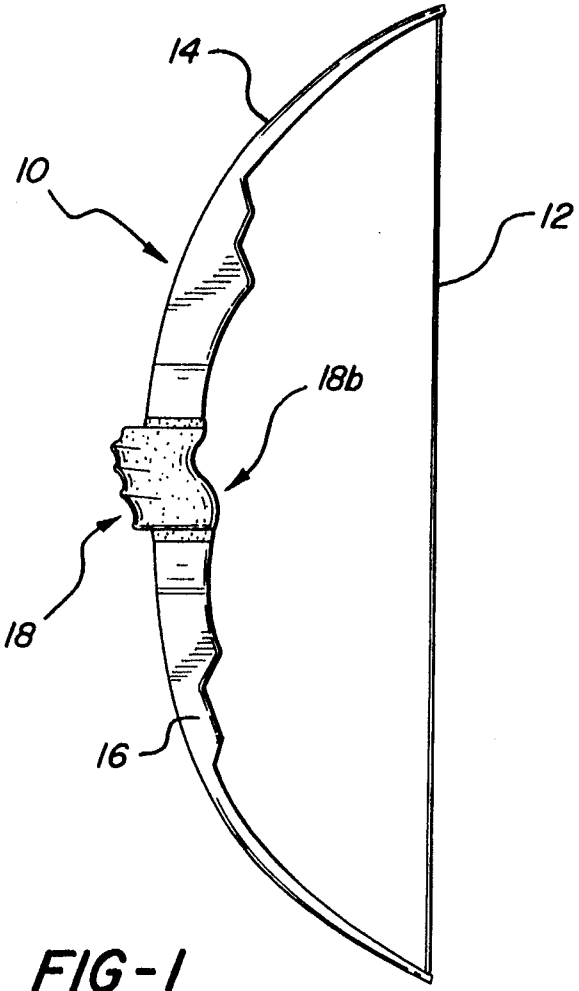
FIG. 1 is a side elevational view of the invention archery bow assembly.

The invention archery bow assembly includes a bow 10 and a bow string 12.

Bow 10 includes an upper limb section 14, a lower limb section 16, and a central handle section 18. Bow string 12 extends in known manner between the free ends of the limb sections 14 and 16 so that the bow is flexed in known manner in response to drawing movement of the bow string. Although the archery bow assembly seen in the FIGURES is of the simple type, the invention is equally applicable to a compound-type bow assembly including compounding pulley assemblies.

Limb sections 14 and 16 are generally of known constructions and may be formed of any suitable metallic, plastic or other material. Bow string 12 is secured in known manner to the free ends of the limb sections so that the bow string and the limb sections lie in a common plane 20.

Central handle section 18 is preferably formed of a moldable material such as a suitable plastic material and includes a main body portion **18*a* and a handle portion 18*b* formed integrally with main body portion 18*a***.

Main body portion **18*a* is generally planar with its central plane generally coinciding with plane 20. Main body portion 18*a* includes an upper end surface 18*c*, a lower end surface 18*d*, a front edge surface 18*e*, a right side surface 18*f*, and a rear edge surface 18*g*. Main body portion 18***a* is secured at its upper end 18*c* to the lower end of upper limb section 14 in any known manner such, for example, as by pinning, and the lower end 18*d* of the main body portion 18*a* is secured to the upper end of lower limb section 16 in any suitable manner.

Figures 4, 5, 6:
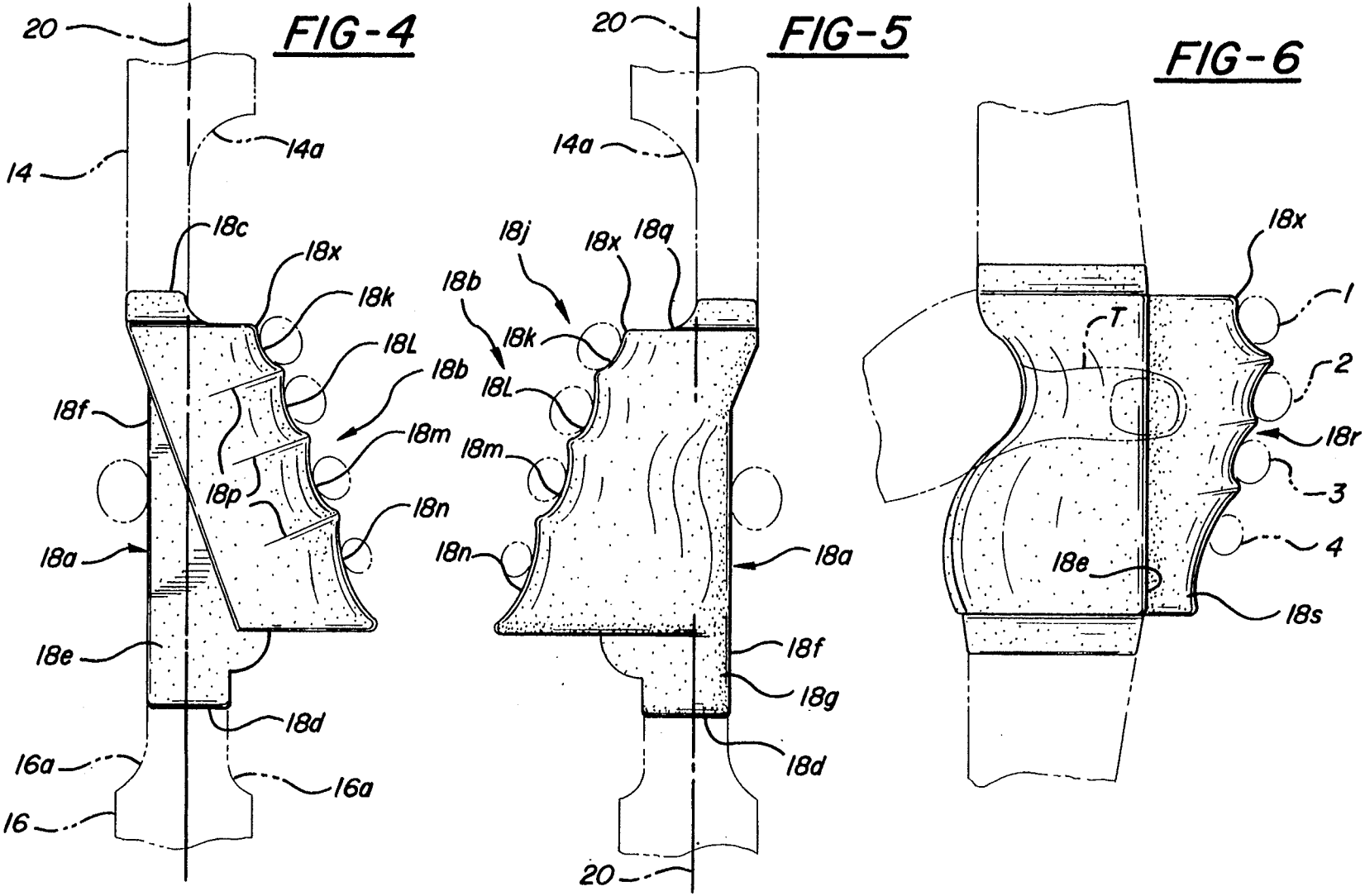

As best seen in FIG. 4, the upper end 18*c* of the main body portion is offset with respect to the central plane 20, and the lower end 18*d* is symmetrical with respect to the central plane 20. The lower end of the upper limb section 14 is cut away at 14*a* to facilitate the attachment of the upper end 18*c* of the central handle section to the lower end of the upper limb section in laterally offset relation to the central plan 20 and the upper end of the lower limb section 16 is cut away proximate each side edge at 16*a* so as to allow the attachment of the lower end 18*d* of the central handle section to the upper end of the lower limb 16 in symmetrical relation to the central plane 20.

Handle portion 18*b* is laterally offset with respect to main body portion 18*a* and with respect to plane 20 and defines a grasping surface 18*j* that extends downwardly and away from the central plane 20, in oblique fashion. Surface 18*j* is divided into four surface areas 18*k*, 18*l*, 18*m* and 18*n*. Each surface 18*k*, 18*l*, 18*m* and 18*n* has a concave configuration in cross section and is separated from the adjacent surface by creases or ridges lines 18*p*. It will be seen that each successive surface area 18*k*, 18*l*, 18*m* and 18*n* is positioned further away from the central plane 20 by the oblique disposition of surface 18*j* and that the upper surface area 18*k*, while the closest of the surface areas to the central plane 20, is itself laterally displayed from the central plane 20 by a laterally extending upper arrow rest surface 18*q*. Arrow rest surface 18*q* extends laterally from a location proximate central plane 20 to a juncture with the upper edge 18*x* of the grasping surface.

As best seen in FIG. 6, the front edge 18*r* of the handle portion 18*b* extends forwardly beyond the front edge 18*e* of the main body portion 18*a* to define a right side handle portion surface 18*s*. The forward extension of the front edge 18*r* of the handle portion beyond the front edge 18*e* of the main body portion will be seen to allow the tips of the archer's fingers to wrap around the front edge of the handle portion and extend rearwardly along surface 18*s* toward the main body portion.

The rear edge 18*t* of the handle portion is contoured to provide an indented concave upper surface portion 18*u* sized and configured to receive the web or crotch between the archer's thumb 30 and the archer's first, or index, finger 32 and a protruding convex lower surface 18*b* sized and configured to accommodate the palm of the archer's hand.

Figure 8:
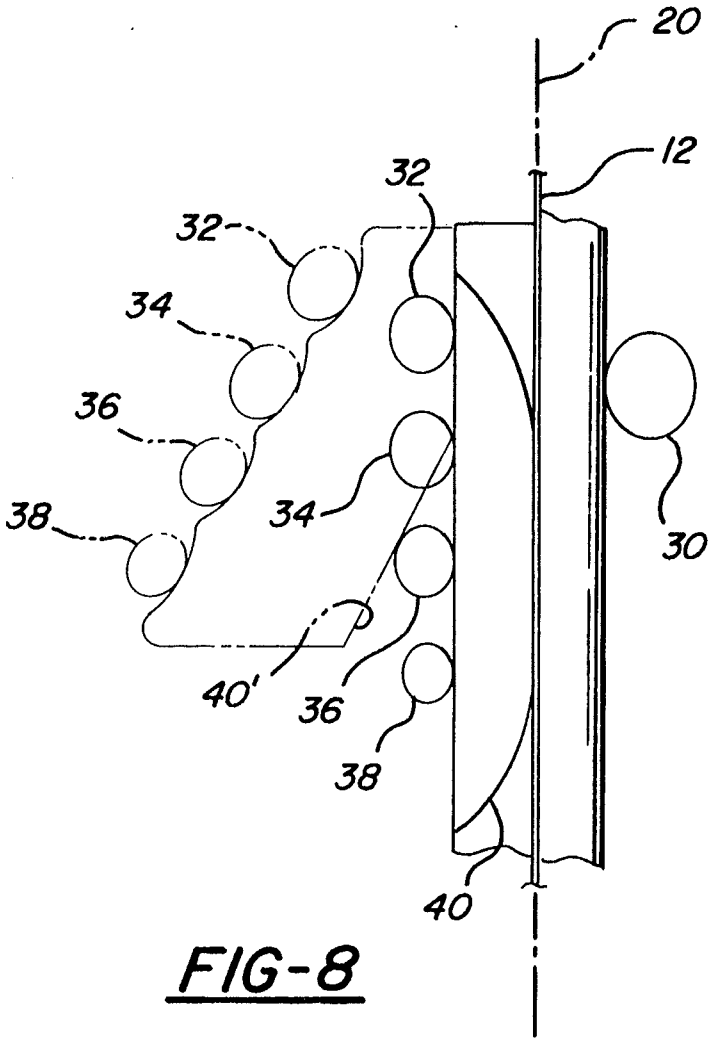
FIG. 8 is a diagrammatic view showing the operation of the invention handle section as compared to the prior art.
Figure 7:
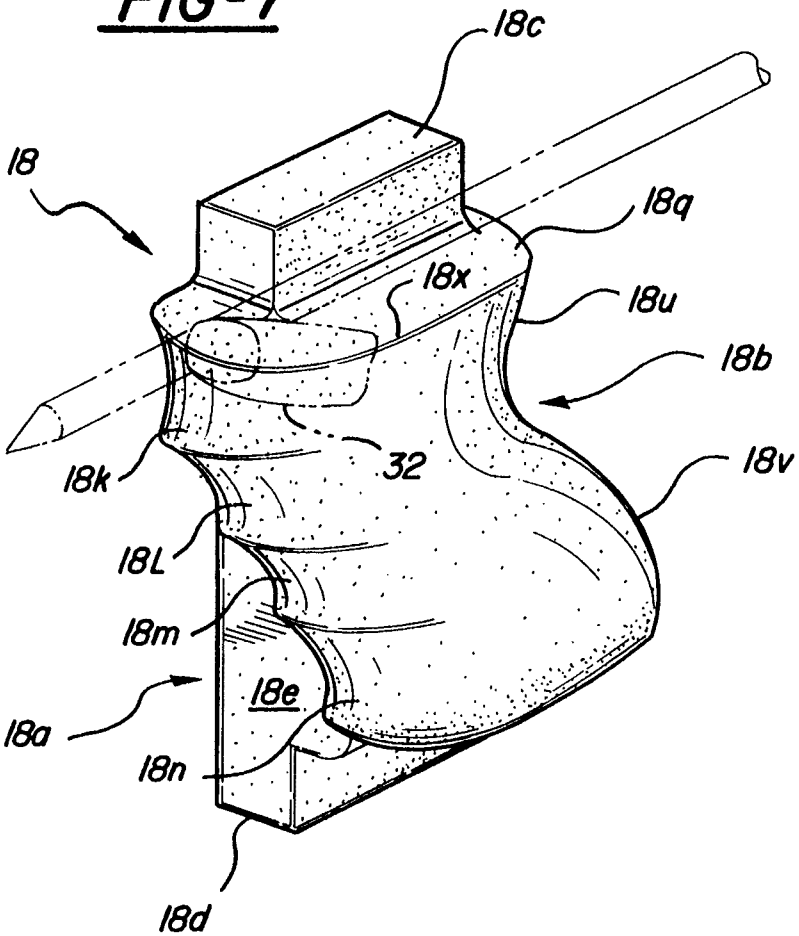
FIG. 7 is a perspective view of the invention handle section.

The manner in which the invention archery bow assembly operates upon arrow release to minimize or preclude chafing of the bow string against the forearm of the archer and to minimize inadvertent twisting of the bow is illustrated schematically in FIG. 8 wherein the operation of the invention bow assembly is compared to the operation of a traditional bow assembly. Specifically, in the traditional bow assembly as seen in solid lines in FIG. 8, the first, second, third and fourth fingers 32, 34, 36, 38 of the archer's hand are positioned in vertically stacked relation along the left side edge of the bow and the thumb 30 assumes an opposed position against the right side of the bow. In this traditional arrangement, the bow string 12 of the bow assembly has a tendency to strum or chafe the inner surface 40 of the archer's arm with consequent discomfort to the archer and possible deflection of the archer's arm in a manner to jerk the bow and derogate the accuracy of the arrow's flight. By contrast, and as seen in dashed lines in FIG. 8, the first, second, third and fourth fingers 32, 34, 36, 38 of the archer in the invention archery bow assembly are disposed along an oblique surface that is laterally displaced from the central plane of the bow assembly so as to position the inner surface 40' of the archer's forearm in a displaced position relative to the bow string 12 so as to preclude or minimize chafing of the bow string against the archer's forearm.

Specifically, the lateral displacement of the upper surface area 18*k* of the grasping surface of the invention handle portion relative to the central plane 20 of the bow assembly has the effect of laterally displacing the inner surface 40' of the archer's forearm relative to the path of the bow string and the oblique disposition of the grasping surface, so that each successive surface area 18*k*, 18*l*, 18*m*, 18*n* is progressively further displaced from the central plane 20, has the effect of rotating the forearm of the archer in a sense to further remove the inner surface 40' of the forearm from the path of the bow string with further minimization or preclusion of the possibility of the bow string chafing the inner surface of the archer's forearm.

The oblique disposition of the user's fingers along the grasping surface 18*j* also allows the archer's fingers to lie in a relaxed disposition, that is, the disposition that the archer's fingers naturally assume when the archer's arm is extended forwardly from his body to grasp the handle section of the bow. This natural disposition of the archer's fingers has the effect of minimizing any tendency of the archer's hand to attempt to move toward its natural position upon release of the arrow and thereby has the effect of minimizing any inadvertent twisting of the bow with consequent inaccuracy.

The invention archery bow assembly will be seen to provide a novel handle structure which is simple and inexpensive in construction; which effectively minimizes or precludes chafing or strumming of the bow string against the inner surface of the forearm of the archer upon release of the bow string, whereby to preclude annoyance to the archer and eliminate inadvertent reactionary movement of the arm, and thereby the bow, during the shooting process; and which allows the archer's hand to assume a natural disposition on the handle of the bow so as to minimize any tendency of the archer's hand to move inadvertently toward its natural position.

Whereas a preferred embodiment of the invention has been illustrated and described in detail, it will be obvious that various changes may be made in the disclosed embodiment without departing from the scope or spirit of the invention.

What is claimed is:

1. A central handle section for connection to upper and lower limb sections to form an archery bow, said central handle section including:

a generally planar main body portion adapted to be secured at its upper end to the lower end of the upper limb section and adapted to be secured at its lower end to the upper end of the lower limb section; and a handle portion formed integrally with said main body portion and defining an oblique grasping surface positioned laterally of the plane of the main body portion and extending downwardly and outwardly with respect to the said plane so that the first finger of an archer's hand, proximate the thumb, is positioned in relative proximity to said plane and each successive finger is positioned further away from said plane so as to rotate the forearm of the archer away from the path of a bow string attached to the limb sections, the handle portion further defining an arrow rest surface extending laterally from a location proximate said plane to a juncture with the upper edge of said grasping surface.

2. A central handle section according to claim 1 wherein said grasping surface is sculptured to define individual concave surface areas for respective receipt of each finger.

3. An archery bow assembly comprising:

upper and lower limb sections lying in a plane; and a central handle section interconnecting said upper and lower limb sections and defining a grasping surface for the hand of the archer, said grasping surface extending downwardly and outwardly with respect to the plane of the limb sections, said handle section including a generally planar main body portion having a central plane generally coinciding with the plane of said limb sections;

said handle being connected at its upper end to the lower end of said upper limb section and being connected at its lower end to the upper end of said lower limb section;

said handle section further including a handle portion integral with said main body portion and defining said grasping surface; and said handle portion including an upper arrow rest surface extending laterally from a location proximate said central plane to a juncture with an upper edge of said grasping surface so as to laterally displace the uppermost portion of said grasping surface, which uppermost portion is adapted to receive the first finger of the archer's hand proximate the thumb, from said central plane and thereby laterally displace the archer's forearm away from the path of the bow string.

4. An archery bow assembly including a bow having upper and lower limb sections and a central handle section interconnecting the limb sections, and a bow string extending between the free ends of the limb sections and lying in a common plane with the limb sections, characterized in that the central handle section includes a handle portion that is laterally offset with respect to the common plane and extends at an angle to the plane, the handle portion defining a grasping surface adapted to receive the four fingers, excluding the thumb, of an archer's hand in side-by-side relation and disposed obliquely with respect to said plane, said grasping surface extending downwardly and away from said plane so that the first finger, proximate the thumb, is positioned in relative proximity to said plane and each successive finger is positioned further away from said plane so as to rotate the forearm of the archer away from the path of the bow string, the handle portion further defining an arrow rest surface extending laterally from a location proximate said plane to a juncture with the upper edge of said grasping surface.

5. An archery bow assembly including a bow having upper and lower limb sections and a central handle section interconnecting the limb sections, and a bow string extending between the free ends of the limb sections and lying in a common plane with the limb sections, characterized in that the central handle section includes a handle portion that is laterally offset with respect to the common plane and extends at an angle to the plane, the handle portion defining a grasping surface adapted to receive the four fingers, excluding the thumb, of an archer's hand in side-by-side relation and disposed obliquely with respect to said plane, said grasping surface extending downwardly and away from said plane so that the first finger, proximate the thumb, is positioned in relative proximity to said plane and each successive finger is positioned further away from said plane so as to rotate the forearm of the archer away from the path of the bow string, the central handle section further including a generally planar main body portion integral with said handle portion and connected at its upper end to the lower end of said upper limb section and connected at its lower end to the upper end of said lower limb section, the front edge of said handle portion extending forwardly beyond the front edge of said main body portion so as to allow the archer's fingers to wrap around the front edge of the handle portion.

6. A central handle section for connection to upper and lower limb sections to form an archery bow, said central handle section including:

a generally planar main body portion adapted to be secured at its upper end to the lower end of the upper limb section and adapted to be secured at its lower end to the upper end of the lower limb section; and a handle portion formed integrally with said main body portion and defining an oblique grasping surface positioned laterally of the plane of the main body portion and extending downwardly and outwardly with respect to the said plane so that the first finger of an archer's hand, proximate the thumb, is positioned in relative proximity to said plane and each successive finger is positioned further away from said plane so as to rotate the forearm of the archer away from the path of a bow string attached to the limb sections, the front edge of said handle portion extending forwardly beyond the front edge of said main body portion so as to allow the archer's fingers to wrap around the front edge of the handle portion.

7. An archery bow assembly comprising:

upper and lower limb sections lying in a plane; and a central handle section interconnecting said upper and lower limb sections and defining a grasping surface for the hand of the archer, said grasping surface extending downwardly and outwardly with respect to the plane of the limb sections, said handle section including a generally planar main body portion having a central plane generally coinciding with the plane of said limb sections;

said handle being connected at its upper end to the lower end of said upper limb section and being connected at its lower end to the upper end of said lower limb section;

said handle section further including a handle portion integral with said main body portion and defining said grasping surface; and a front edge of said handle portion extending forwardly beyond a front edge of said main body portion so as to allow the archer's fingers to wrap around the front edge of the handle portion; and said handle portion including an upper arrow rest surface extending laterally from a location proximate said central plane to a juncture with an upper edge of said grasping surface so as to laterally displace the uppermost portion of said grasping surface, which uppermost portion is adapted to receive the first finger of the archer's hand proximate the thumb, from said central plane and thereby laterally displace the archer's forearm away from the path of the bow string.

* * * * *